US005107956A

United States Patent [19]

Constantinis et al.

[11] Patent Number: 5,107,956

[45] Date of Patent: Apr. 28, 1992

[54] DESCENDING DEVICE

[75] Inventors: Daniel A. Constantinis, Wilmslow, England; Roger O'Donovan, Gorthleck, Scotland; David M. Mortlock, Insch, Great Britain

[73] Assignee: Engineering Management and Inspection (Safety Systems) Limited, Manchester, England

[21] Appl. No.: 681,545

[22] PCT Filed: Nov. 1, 1989

[86] PCT No.: PCT/GB89/01302

§ 371 Date: Jul. 10, 1991

§ 102(e) Date: Jul. 10, 1991

[87] PCT Pub. No.: WO90/04998

PCT Pub. Date: May 17, 1990

[30] Foreign Application Priority Data

Nov. 12, 1988 [GB] United Kingdom ..... 8826522
May 2, 1989 [GB] United Kingdom ..... 8909997

[51] Int. Cl.[5] ..... A62B 1/20
[52] U.S. Cl. ..... 182/5; 188/65.4
[58] Field of Search ..... 182/3, 5, 6, 7, 8; 188/65.4

[56] References Cited

U.S. PATENT DOCUMENTS

| | | | |
|---|---|---|---|
| 284,763 | 9/1883 | Scholl | 182/7 |
| 3,419,236 | 12/1968 | Weber | 182/5 |
| 4,102,431 | 7/1978 | Carroll | 182/5 |
| 4,508,193 | 4/1985 | Forrest | 182/5 |
| 4,714,135 | 12/1987 | Bell | 182/6 |

*Primary Examiner*—Reinaldo Machado
*Attorney, Agent, or Firm*—Nies, Kurz, Bergert & Tamburro

[57] ABSTRACT

A device whereby personnel or other loads may descend from an elevated position at a controlled and variable speed, comprising a restraining member (12) having a series of slots (13). A tape stored in a container (20) passes through the slots (13) to a hook (10) for attachment of the device to a fixed point. A user wearing a harness (21) removably attached to the restraining member (12) may descend at a controlled rate determined by a light load applied to the tape (11) below the restraining member (12) owing to the frictional contact of the tape (11) passing around the edges of slots (13). After the descent a quick release shackle (16) releases the harness (21) from the device.

16 Claims, 5 Drawing Sheets

DESCENDING DEVICE

This invention concerns a device to enable personnel or other loads to descend from an elevated position at a controlled and variable speed.

Such a device may be used, for example, to permit rapid escape of personnel from installations such as offshore drilling platforms or other high-rise structures. The device may be operated and controlled by the user himself or by other personnel for lowering casualties or other loads in a controlled manner.

Many known devices for these purposes are uncontrollable to the extent that once the load is descending it does so at a constant speed with no means of stopping until it reaches a position of rest at a lower level. This may be unsuitable when escaping into the sea from a drilling platform where the user may wish to remain suspended part way down until rescue services arrive.

An object of the present invention is to provide a simple and inexpensive device which may be attached to any fixed point at an upper level, and which is so compact as to be stored in numbers sufficient for all personnel present at that level. The device must be made ready for use immediately and may be incorporated into a safety harness or a survival suit containing a harness.

According to the present invention, there is provided a descending device to enable personnel or other loads to decend from an elevated position at a controlled and variable speed, comprising a restraining member to which the load may be attached and having therein a series of apertures which frictionally contain a line such as a tape or rope which passes therethrough in alternate directions, one or more edges of each aperture defining a contact surface providing frictional engagement for the line as the load descends, a loop or hook for attachment of the line to a fixed point at said elevated position, a container for a store of the line sufficient to permit the required descent, and a restricted opening in the container to provide a frictional relationship between the line and the opening for the controlled pay-out of line therethrough.

Preferably, there is also included a harness to be worn by the user, which is adapted to be attached to the restraining member and to the container by one or more quick release shackles.

The harness may be of a so-called "nappy" type or may consist of a waist band and crotch straps with means for attachment of the restaining member to at least one loop at the front of the waist band, whilst the container is attached to the side region of the harness. Still further, the entire harness may be incorporated into a survival suit which may have provision for the container to be attached the suit about the wearer's knee or any other accessible position.

Embodiments of the invention will now be described, by way of example only, with reference to the accompanying drawings in which.

Figure 1:
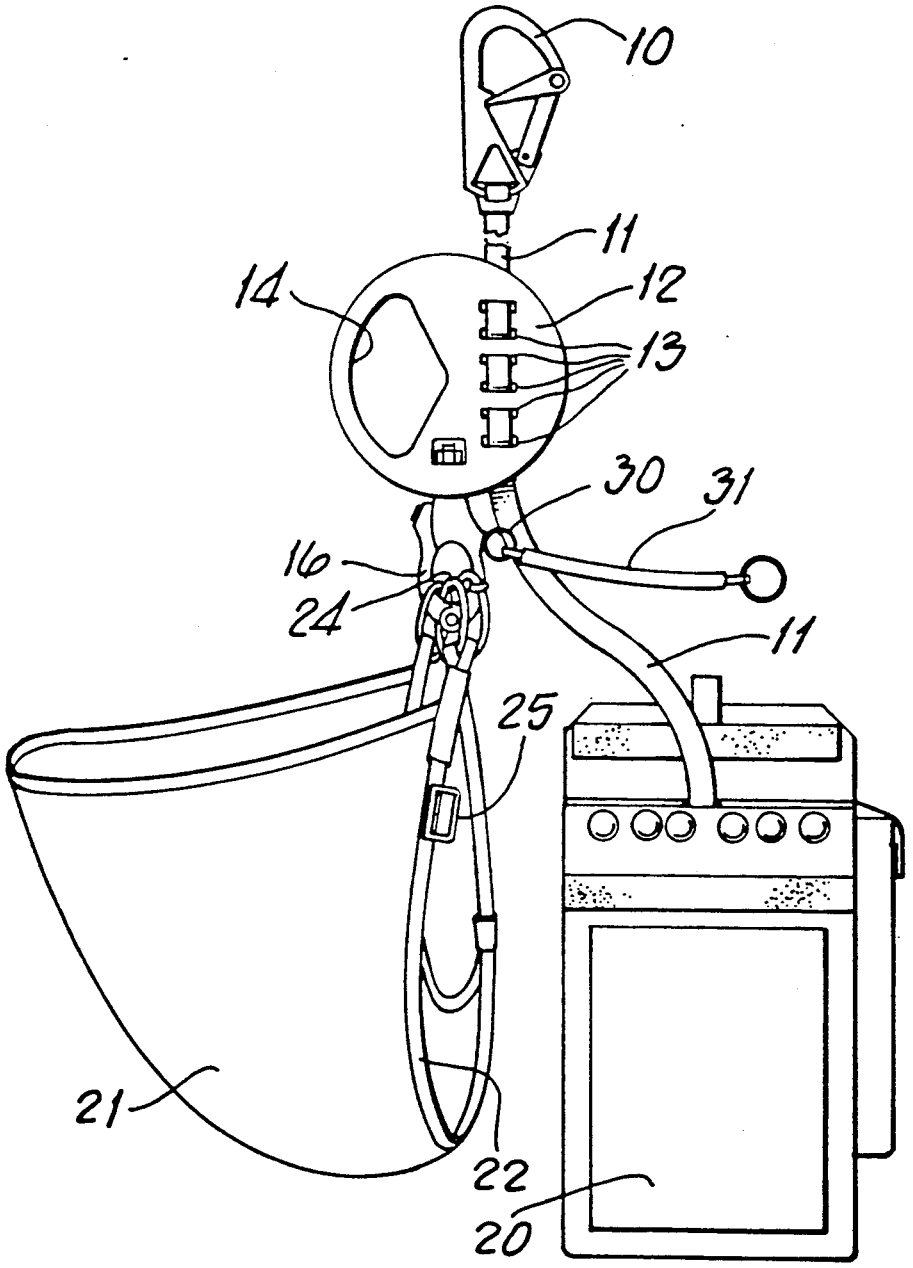
FIG. 1 is a general illustration of a descending device made in accordance with the invention.
Figure 7:
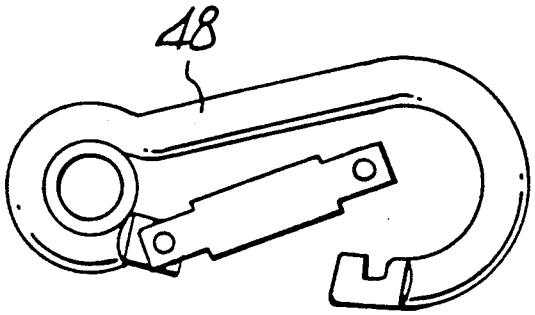
Figure 6:
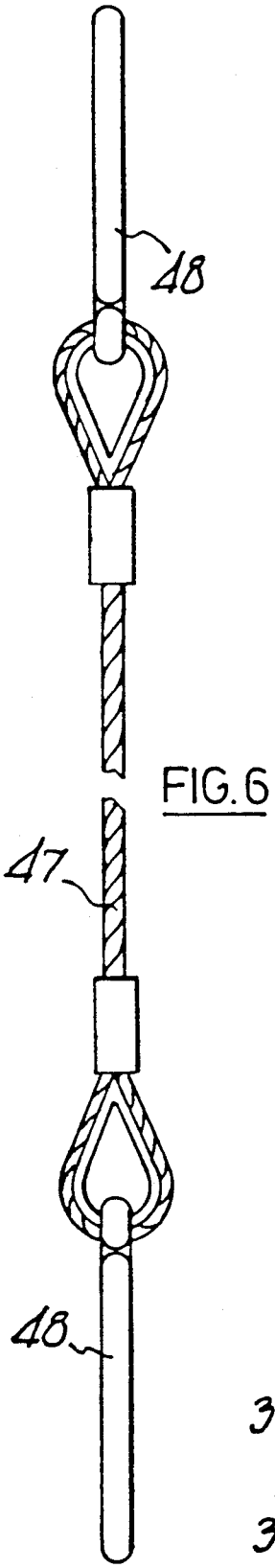
Figure 5C:
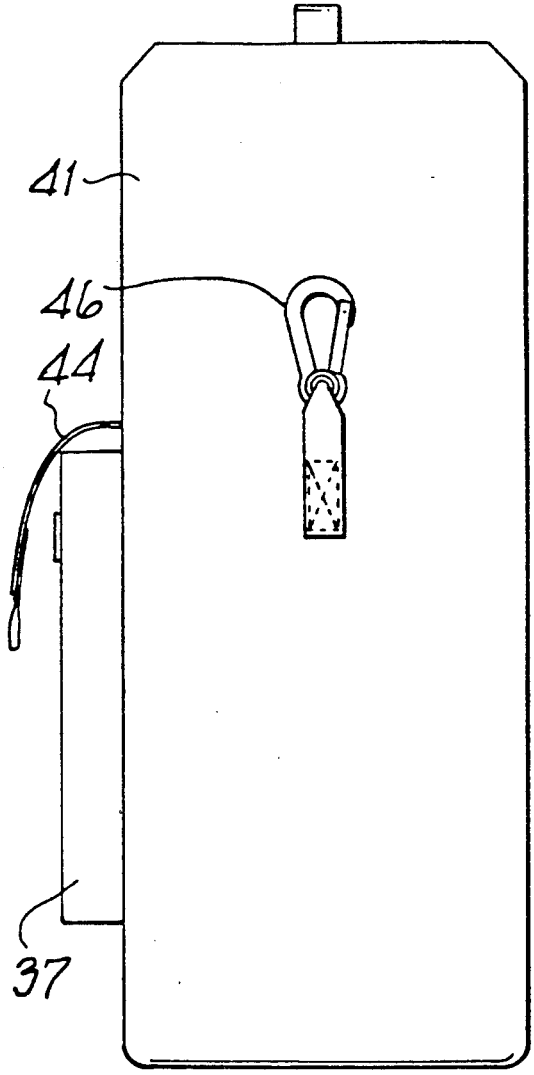
Figure 5D:
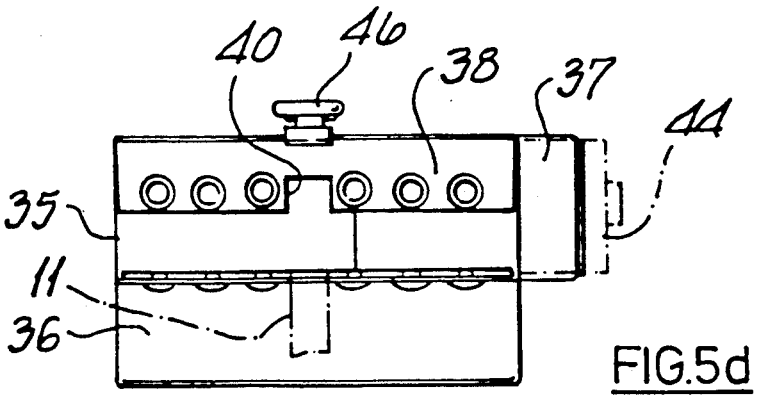

FIGS. 5*a* to 5*d* are respectively front side and rear elevations and a plan view of part of the device as illustrated in FIG. 1;

FIG. 6 illustrates an accessory to be housed within and usuable with the device; and FIG. 7 illustrates a spring-loaded hook forming part of the accessory illustrated in FIG. 6.

Referring now to the drawings, a descending device made in accordance with the invention comprises a spring-loaded hook 10 for attachment of the device to a fixed point at an elevated position from which as user is to descend. This may be, for example, a hand rail on the deck of an offshore drilling platform. Permanently fixed to the hook 10 is an upper looped end of a tape 11 which may be made from nylon or other synthetic material and should be designed to have a breaking strain in the region of 1000 Kg (straight load). The tape is preferably brightly coloured in two or more fluorescent colours so as to be readily seen in conditions of poor visibility. Although not illustrated in the drawings, the tape may be provided with graduated markings at metre spacing so that it may be easily paid out to a predetermined length. Also, the tape may be date-coded by incorporating visual stitching representing a certain period or date of manufacture.

Figure 2:
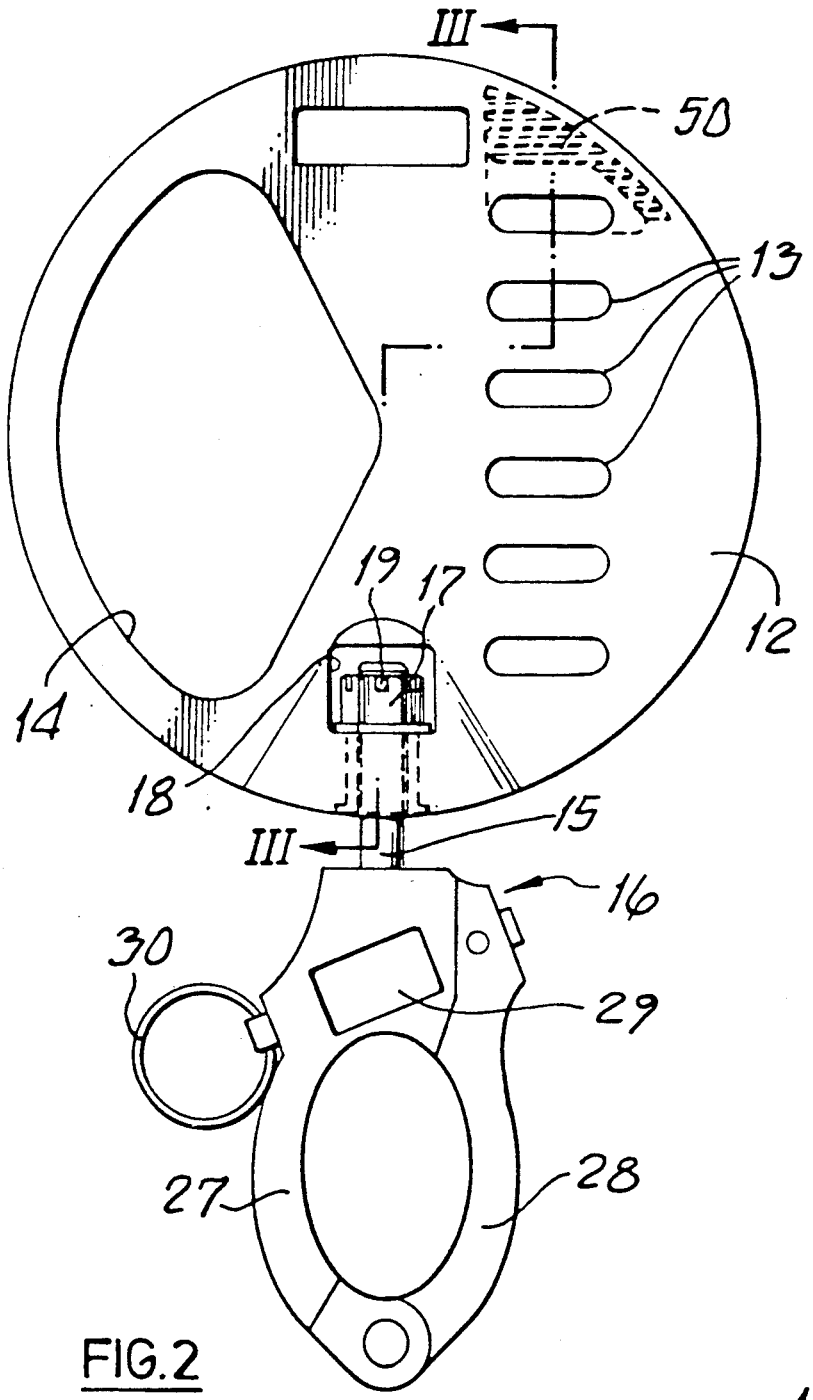
FIG. 2 is an enlarged view of a restraining member forming part of the device illustrated in FIG. 1.

A principal component of the device is provided in the form of a disc-shaped restraining member 12 preferably of aluminum and defining a series of parallel elongate slots 13 through which the tape 11 passes alternately in opposite directions. The restraining member 12 incorporates a large aperture 14 which may serve as a hand grip. Near the base of the member 12 its thickness is increased to receive the shaft 15 (see FIG. 2) of a quick release shackle 16. The shaft 15 is secured by a slotted nut 17 which is received within a recess 18 in the base of the member. The nut 17 is secured by a roll pin 19. The remainder of the tape 11 below the member 12 in FIG. 1 is stored within a bag 20 details of which will be described in relation to FIGS. 5*a* to 5*d*.

Figure 4:
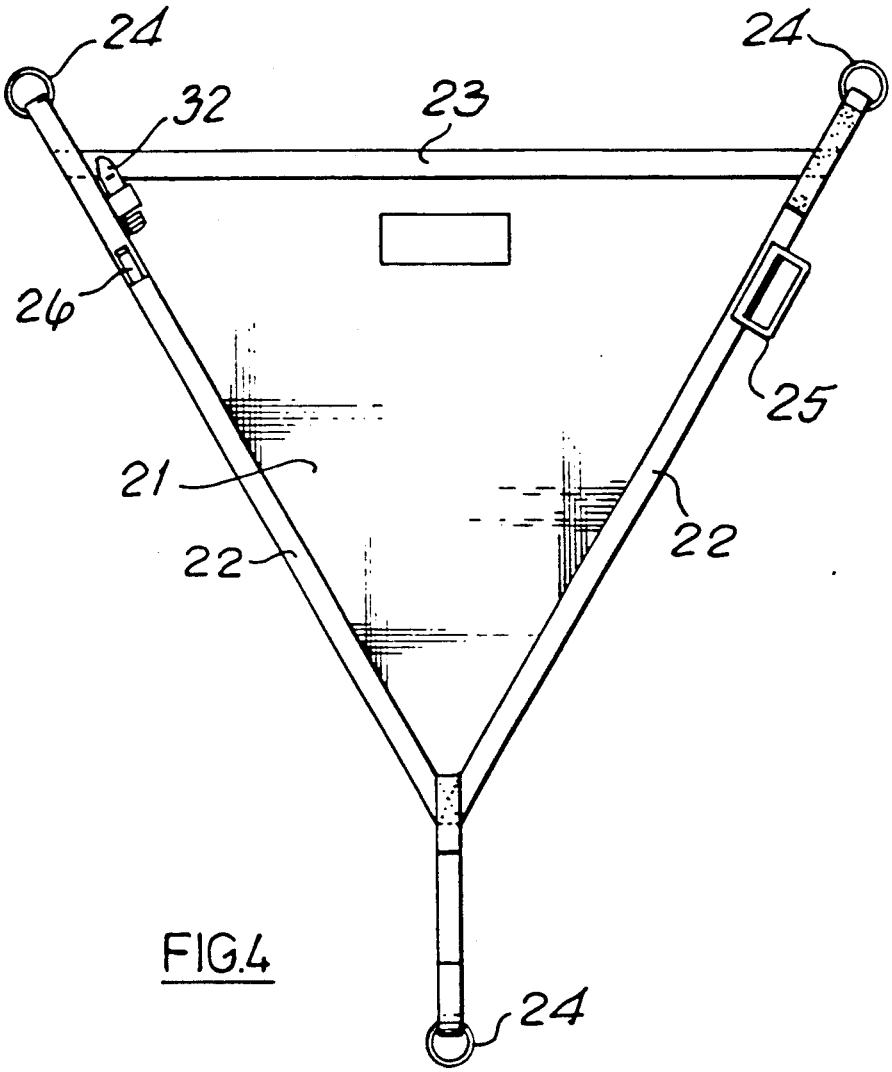
FIG. 4 illustrates a harness in a laid flat condition.

The descending device is completed by a "nappy" type harness 21 which as can be seen from FIG. 4 comprises a triangular arrangement of webbing straps 22 and 23. Attachment rings 24 are provided at the three corners. Preferably, strap 23 is elasticated and may be coloured differently from the straps 22 so as to be readily identifiable as the waistband of the harness. At the bottom FIG. 4 the central ring 24 is attached by load bearing stitching which is designed to fail before the stitching for the other two rings so that the harness may still be supportive under the arms of the user should the centre strap fail.

The central portion of the harness enclosed by straps 22 and 23 is produced from a nylon sheet stitched to and between the straps and is preferably coloured brightly so as to be clearly visible to rescue personnel.

Fixed to one side strap 22 of the harness is a so-called "gear rack" 25 to which the bag or container 20 may be attached in use. Fixed to the other strap 22 is a harness knife 26 which may be used, for example, to cut lines in use when required, and a whistle 32.

Figure 3:
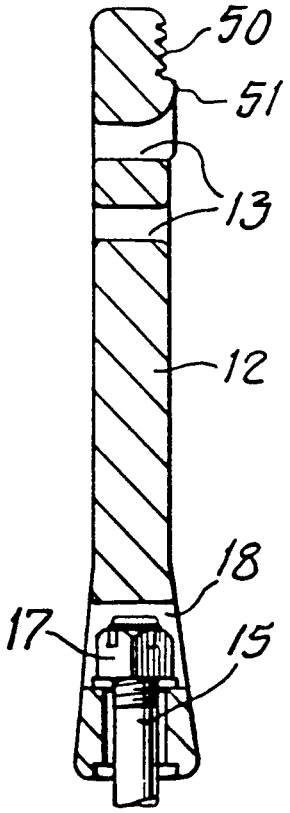
FIG. 3 is a section taken on line III—III of FIG. 2.

As can be seen from FIGS. 1 and 3 the quick release shackle 16 consists of a first part 27 integral with or fixed to shaft 15 and a pivotally attached second part 28 which is maintained in a closed condition by means of a spring-loaded catch 29 having a pull ring 30. A short length of line 31 (FIG. 1) is attached to pull ring 30 and may carry a whistle (not shown). The line 31 is preferably attached temporarily to the harness by means of "break" beading which prevents the catch 29 from being opened prematurely or inadvertently.

Referring now to FIGS. 5*a* to 5*d*, the container 20 comprises a first compartment 35 in which is stored a sufficient length of tape 11 for the required descent. This will depend upon the level from which escape may be required.

A further compartment 36 is large enough to contain the restraining member 12, the harness 21, the upper part of the tape 11 and the hook 10.

A further small compartment 37 on the side of the bag 20 may contain accessories such as that illustrated and to be described in relation to FIGS. 6 and 7.

Figure 5A:
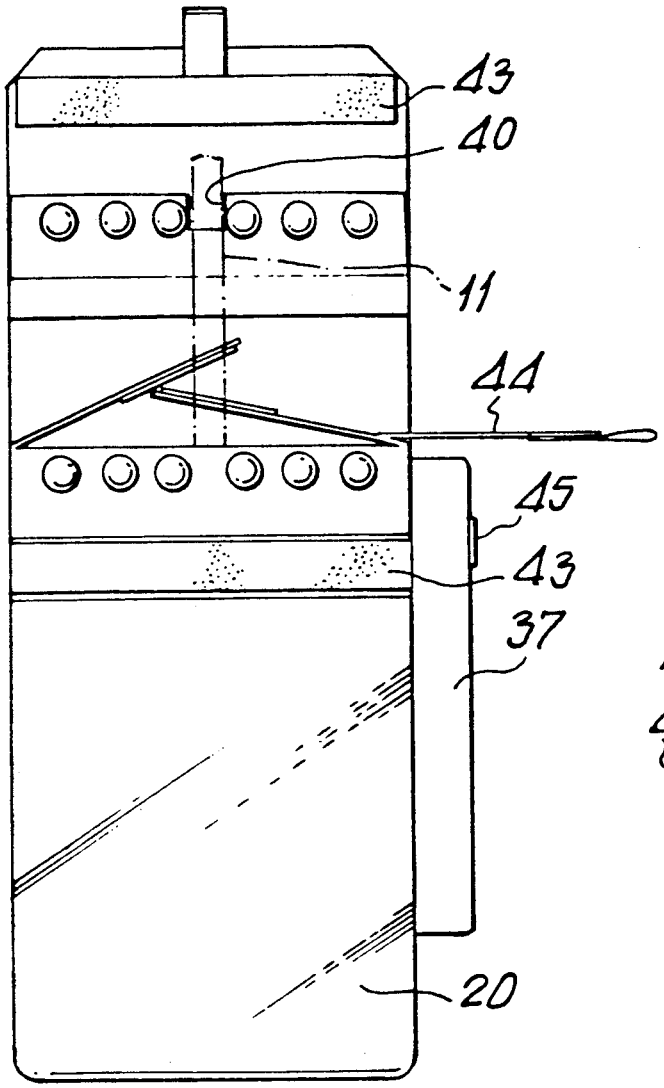
Figure 5B:
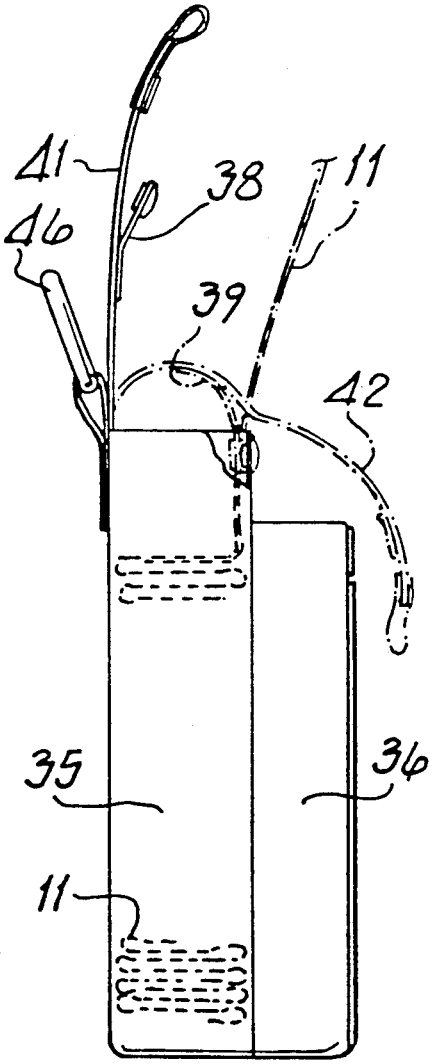

As seen in FIG. 5*b* the first compartment 35 is closed by a flap 38 having press studs or similar fastenings which attach inside the top of the compartment 35 as illustrated by dotted lines 39. The flap 38 contains a tape feed slot 40 (see FIGS. 5*a* and 5*d*) which is centrally disposed in the flap and is designed to be of a width just narrower than the width of the tape 11 thus forming a restricted opening for the controlled payout of the tape.

A further, main flap 41 closes compartments 35 and 36 as illustrated by dotted line 42. Preferably, flap 41 is closed by strips 43 of touch-and-close fastener.

Similarly, side compartment 37 is closed by a flap 44 with strips 45 of similar fastener.

A spring-loaded release hook 46 is provided at the rear of the container 20 for attachment to the gear rack 25 on the harness 21.

Referring now to FIG. 6 there is illustrated therein an accessory in the form of a stainless steel cable strop 47 having secured at each end thereof a spring-loaded hook 48 (see FIG. 7). The purpose of this accessory will be described hereinafter.

Referring again to FIGS. 2 and 3 there is provided in the upper region of the restraining member 12 on one face thereof a toothed formation 50 which may be used, as will be described, to lock the device temporarily against continued descent. A raised lip 51 prevents the tape 11 from rubbing against the formation 50 in normal use.

The entire device is preferably shrink-wrapped in a transparent envelope with a quick-release sealing strip. When required for use it is taken from the envelope and the hook 10 is secured to a fixed point such as a handrail on the deck of a drilling platform. The user puts on the harness and locates its three rings 24 in the quick release shackle 16. The tape 11 may be pulled through the restraining member 12 to provide sufficient free tape above the device for the user to put on the harness and lower himself over the rail. Once freely suspended the user may control the rate of descent by paying out tape from the bag 20, or simply allow it to payout at the controlled rate determined by the restricted opening 40 in the bag. At any time descent may be arrested either by simply applying a light hold on the tape 11 below the restraining member 12, preferably holding the tape to one side, or additionally by looping the bottom part of the tape over the restraining member 12 so that it is trapped between the latter and the upper part of the tape 11 in the region of the toothed formation 50. This will have the effect of locking the device against further descent until the free part of the tape is released.

Once the user has decended to the required level he may pull the toggle 33 releasing catch 16 which is so designed that, of the rings 24, one side ring and the front ring are released initially so that the occupant will roll out of the harness in a sideways direction leaving the entire device suspended on tape 11.

The purpose of the swivel connection of shackle 16 to restraining member 12 is to enable the latter to be gasped by the left or right hand selectively.

If it is required, during descent, to follow the line of, for example, a painter mooring a liferaft to the drilling platform, then the wire strop 42 may be additionally hooked onto shackle 16, using one of its spring-loaded hooks 48, and onto the painter using the other one. In this way the user will descend alongside the painter to a position at or very close to the liferaft.

A further and alternative use of the wire strop 42 may be to secure the entire device at the elevated position when only hot surfaces are available for attachment for example in a fire. In this case, the length of wire may be wrapped around a rail so that the hook 10 is indirectly connected thereto thus keeping the tape 11 well away from all hot surfaces which may cause it to disintegrate.

The frictional containment of the tape 11 within the restraining member 12 is such that, for example, a 250 kg load may be placed on the restraining member whilst the tape may be prevented from passing through the apertures 13 by applying a very light holding load in the region of 3 or 4 kg.

For practical purposes the descending device may be stored permanently in a pocket attached to a survival suit or alternatively in separate envelopes kept individually by personnel or stored at a number of established escape locations.

The device may be readily used to lower injured persons or other loads to a lower level by another person controlling that part of the tape 11 issuing from the container 20, from the elevated position. In this case, the tape 11 must be twice the length of that required for self-descent if the load is attached as normal to the shackle 16. Alternatively, the load may be attached to the hook 10 with the shackle 16 connected to the fixed point so that the entire device operates in an upside down mode.

Whilst a lightweight metallic alloy is preferred for the restraining member 12 it may be produced from a rigid plastics material with metallic inserts around the apertures 13 to dissipate heat generated by the frictional contact of the tape, and to prevent wear.

The shape of the restraining member 12 may be other than disc-like so long as it provides a plurality of contact surfaces spaced and interdisposed so as to cause the tape to travel in frictional contact over the surfaces and to change direction several times. Whilst the hand grip aperture 14 is preferable and provides a certain comfort to personnel using the device, it is not essential.

We claim:

1. A descending device to enable personnel or other loads to descend from an elevated position at a controlled and variable speed, comprising a restraining member to which the load may be attached and having therein a series of apertures which frictionally contain a line such as a tape or rope which passes therethrough in alternate directions, one or more edges of each aperture defining a contact surface providing frictional engagement for the line as the load descends, a loop or hook for attachment of the line to a fixed point at said elevated position, a container for a store of the line sufficient to permit the required descent, and a restriced opening in the container to provide a frictional relationship between the line and the opening for the controlled pay-out of line therethrough.

2. A descending device according to claim 1, including a harness to be worn by the user and having a quick releasable means for attachment to the restraining member.

3. A device according to claim 2, wherein the harness comprises a triangular arrangement of waistband and crotch straps with attachment rings at its three corners.

4. A descending device according to any preceding claim, wherein the line is a flat tape and the apertures in the restraining member are formed as a series of parallel elongate slots through which the tape passes alternately in opposite directions.

5. A descending device according to claim 1, wherein the restraining member is disc-shaped and incorporates a large aperture which may serve as a hand grip, and there is rotatably mounted on the restraining member a quick release shackle to which the load may be attached.

6. A descending device according to claim 1, wherein the storage container for the line comprises a bag having first and second compartments in which, before use, the line and the restraining member respectively are stored.

7. A descending device according to claim 6, wherein the bag includes a still further compartment for accessories.

8. A descending device according to claim 1, wherein the restricted opening in the container comprises a line feed slot in a flap normally closing said first compartment, and being of a width just narrower than the width of the line for the controlled pay out thereof.

9. A descending device according to claim 7, wherein at least one of said compartments is normally closed by a flap having strips of touch and close fastener.

10. A descending device according to claim 1, wherein said restraining member includes in a surface region thereof a toothed formation against which the line may be trapped to lock the device temporarily against continued descent.

11. A descending device according to claim 10, wherein the restraining member includes a raised portion to prevent the line from rubbing against said toothed formation in normal unlocked use.

12. A descending device according to claim 1, wherein the frictional engagement of the line with said contact surfaces is sufficient that with a 250 kg load placed on the restraining member, the line may be prevented from passing through the apertures by applying a holding load of 4 kg or less on the line on the opposite side of the restraining member from that on which the load is applied.

13. A descending device according to claim 1, wherein the restraining member is made from a lightweight metallic alloy.

14. A descending device according to claim 1, wherein the line is in the form of a flat tape of a synthetic material having a breaking strain in the region of 1,000 kg (straight load).

15. A descending device according to claim 14, wherein the tape carries spaced graduated markings whereby its length of pay-out may be visually monitored and is date-coded by incorporating visual stitching representing a certain period or date of manufacture.

16. A descending device according to claim 2, wherein the harness is incorporated into a survival suit having attachment means for the container.

* * * * *